United States Patent [19]

Latimer, Jr.

[11] Patent Number: 4,928,970

[45] Date of Patent: May 29, 1990

[54] BINGO CHIP DISPENSER

[76] Inventor: Richard G. Latimer, Jr., 12 W. 4th St., Oswego, N.Y. 13126

[21] Appl. No.: 347,587

[22] Filed: May 5, 1989

[51] Int. Cl.[5] ..... A63F 9/00

[52] U.S. Cl. ..... 273/148 R; 453/47

[58] Field of Search ..... 273/148 R; 453/43, 44, 453/45, 46, 47, 48

[56] References Cited

U.S. PATENT DOCUMENTS

| | | | |
|---|---|---|---|
| 1,150,914 | 8/1915 | Whitcomb | 453/44 |
| 1,717,037 | 6/1929 | Kallio | 273/148 R X |
| 3,179,413 | 4/1965 | Leclerc | 273/87.4 |
| 4,113,143 | 9/1978 | Spagnola, Jr. | 453/51 X |
| 4,216,878 | 8/1980 | Naud | 273/148 R X |
| 4,413,750 | 11/1983 | Morrone et al. | 273/148 R X |
| 4,830,375 | 5/1989 | Fleming | 273/148 R |

*Primary Examiner*—Anton O. Oechsle
*Attorney, Agent, or Firm*—Leon Gilden

[57] ABSTRACT

A bingo chip dispenser is set forth utilizing an elongate cylinder including a pivotally mounted lid with a lowermost hood oriented relative to an opening within the cylinder. A plunger is diametrically aligned with and opposed to the opening within the hood and further includes a thumb loop secured to the hood and a forward wall of the cylinder with an index and middle finger loop positioned diametrically opposed to the thumb loop with the thumb loop aligned with the middle finger loop to provide a coacting force applied to the plunger, wherein the middle finger loop is directed rearwardly of the index finger loop and beyond a floor of the cylinder.

7 Claims, 1 Drawing Sheet

BINGO CHIP DISPENSER

BACKGROUND OF THE INVENTION

1. Field of the Invention

The present invention relates to dispensing devices, and more particularly pertains to a new and improved bingo chip dispenser wherein the same provides for a multiple finger loop arrangement to counteract forces when dispensing chips from the dispenser and further utilizes a rib interiorly of the dispensing cylinder to maintain alignment of the chips therein.

2. Description of the Prior Art

Dispensers of various types have been utilized throughout the prior art to direct articles as desired from the dispensers. Particularly bingo chip dispensers are utilized to facilitate the positioning of chips upon a game card, such as a bingo card, to provide compact and secure storage of the chips to prevent their spillage during the playing of a bingo game. Example of a prior art device is set forth in U.S. Pat. No. 3,877,473 to Williams utilizing an open cylinder provided with a plurality of spaced fingers diametrically opposed to one another to enable sequential dispensing of bingo chips contained within the cylinder.

U.S. Pat. No. 4,216,878 to Naud sets forth a further example of a bingo chip dispenser of a one-piece unit wherein a plurality of off-set cylinders and a medially positioned plunger directs chips from one dispenser to a second dispenser to position bingo chips, as desired, upon a playing card.

U.S. Pat. No. 4,113,143 to Spagnola, Jr. sets forth a bingo chip dispenser with an elongate cylindrical body and a plurality of diametrically opposed fingers to engage the bingo chips with an overlying plunger to direct and exert a force upon a uppermost chip and direct &he chips through a bottom opening of the dispenser.

U.S. Pat. No. 4,413,750 to Morrone sets forth a chip dispenser utilizing a pivotally mounted displacement member to direct chips from a stack through a lowermost opening and into a chute to position the chips onto a bingo playing card.

U.S. Pat. No. 4,619,376 to Huss sets forth a bingo chip dispenser utilizing a cylinder and rearwardly mounted pistol grip arrangement to direct bingo chips through a lowermost slot in a cylinder and onto a playing card.

As such, it may be appreciated that there is a continuing need for a new and improved bingo chip dispenser wherein the same addresses both the problems of directing bingo chips onto a playing card in a secure and stable manner, as well as directing unique bingo chips thereon to impart unique tokens onto the bingo chip to distinguish a playing card from other players as well as enhancing a player's enjoyment of the game.

SUMMARY OF THE INVENTION

In view of the foregoing disadvantages inherent in the known types of bingo chip dispensers now present in the prior art, the present invention provides a bingo chip dispenser wherein the same provides for a stable and secure device for directing bingo chips onto an underlying playing card utilizing unique bingo chips, as desired. As such, the general purpose of the present invention, which will be described subsequently in greater detail, is to provide a new and improved bingo chip dispenser which has all the advantages of the prior art bingo chip dispensers and none of the disadvantages.

To attain this, the present invention comprises a bingo chip dispenser utilizing an elongate cylinder with a pivotally mounted lid provided with a tab to secure the lid to an upper end of the cylinder. The cylinder includes an underlying opening positioned at a lowermost portion of the cylinder directed adjacent a floor of the cylinder with a hood positioned overlying the opening to direct chips from the opening to an underlying bingo card. A forwardly mounted thumb loop is generally aligned with a diametrically opposed and rearwardly positioned middle finger loop to provide counteracting forces on the cylinder to impart stability in use of the cylinder. An index finger loop is positioned overlying the middle finger loop with a plunger positioned within the middle finger loop to direct bingo chips through the opening. An elongate rib coextensive with an interior wall of the cylinder diametrically opposed to the middle finger and index finger loops is positioned to register with indentations within bingo chips to maintain the bingo chips in an aligned relationship within the cylinder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bingo chip dispenser which has all the advantages of the prior art bingo chip dispensers and none of the disadvantages.

It is another object of the present invention to provide a new and improved bingo chip dispenser which may be easily and efficiently manufactured and marketed.

It is a further object of the present invention to provide a new and improved bingo chip dispenser which is of a durable and reliable construction.

An even further object of the present invention is to provide a new and improved bingo chip dispenser which is susceptible of a low cost of manufacture with regard to both materials and labor, and which accordingly is then susceptible of low prices of sale to the consuming public, thereby making such bingo chip dispensers economically available to the buying public.

Still yet another object of the present invention is to provide a new and improved bingo chip dispenser which provides in the apparatuses and methods of the prior art some of the advantages thereof, while simultaneously overcoming some of the disadvantages normally associated therewith.

Still another object of the present invention is to provide a new and improved bingo chip dispenser wherein the same provides for counteracting forces in the manual displacement of bingo chips from within the dispenser, as well as maintaining alignment of chips within the dispenser in the use of uniquely arranged chips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
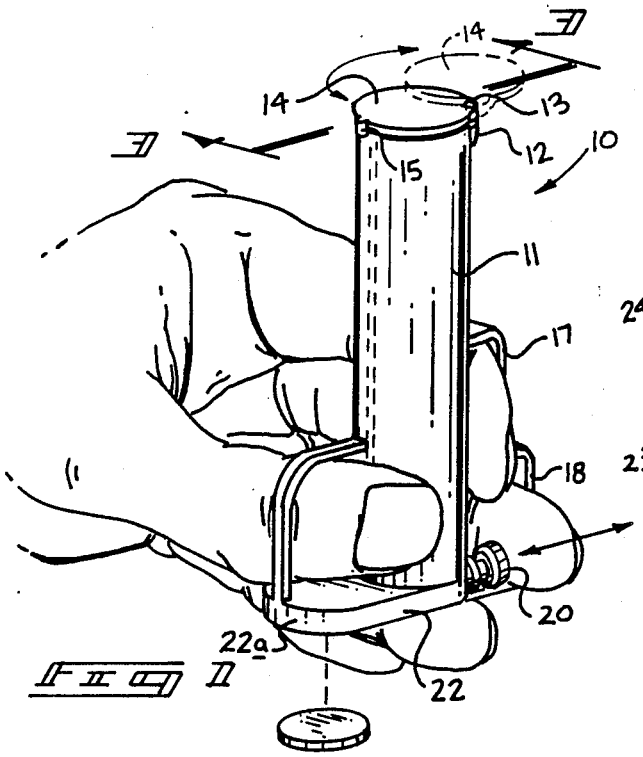
FIG. 1 is an isometric illustration of the instant invention in use.
Figure 2:
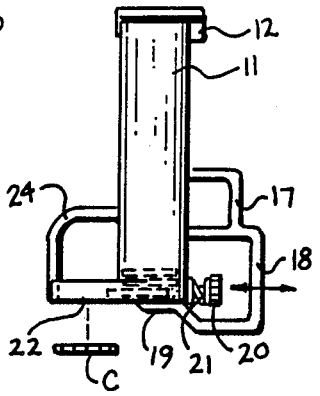
FIG. 2 is an orthographic side view taken in elevation of the instant invention.

With reference now to the drawings, and in particular to FIGS. 1 to 6 thereof, a new and improved bingo chip dispenser embodying the principles and concepts of the present invention and generally designated by the reference numeral 10 will be described.

Figure 3:
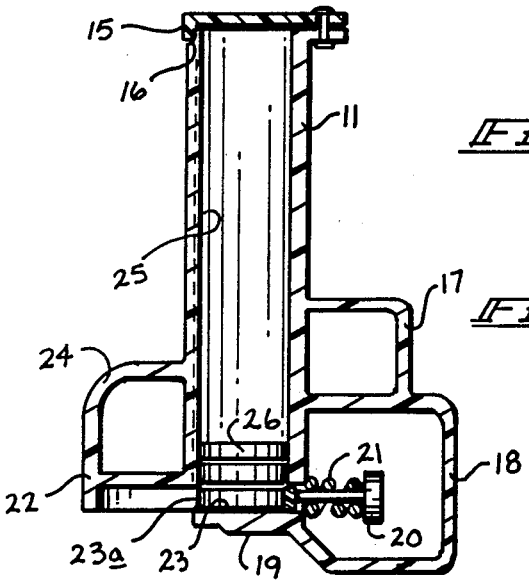
FIG. 3 is an orthographic view taken along the lines 3—3 of FIG. 1.
Figure 4:
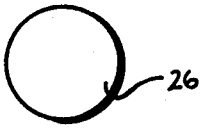
FIG. 4 is a top orthographic view of a conventional bingo chip, as may be utilized by the invention.
Figure 5:
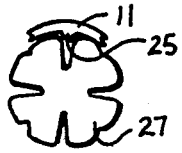
FIGS. 5 and 6 are top orthographic views of uniquely configured bingo chips and their alignment with the coextensively positioned rib of the instant invention.
Figure 6:
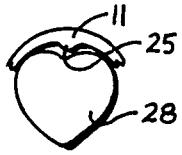

More specifically, it will be noted that the bingo chip dispenser apparatus 10 essentially comprises an elongate cylindrical body 11 with a pivot hinge 12 secured proximate an upper edge of the cylindrical body 11 with an upwardly directed pivot pin 13 pivotally mounting a lid 14. The lid 14 includes a downwardly oriented projection 15 diametrically opposed to pivot pin 13 accommodated within a semi-cylindrical recess 16 diametrically opposed to the pivot hinge 12 of the cylindrical body 11. Formed adjacent the lowermost portion of the cylindrical body 11 is a middle finger loop 18 underlying an index finger loop 17 aligned with the middle finger loop 18. The middle finger loop extends beyond the index finger loop 17 and below a bottom surface 19 of the cylindrical body 11. Positioned within the outwardly extending middle finger loop 19 is a bias plunger 20 including a captured spring 21 to normally orient the plunger 20 in an extended position whereupon compression of the plunger 20 against the spring 21 ejects a chip 26 from a stack enclosed within the cylindrical body 11. Diametrically opposed to the plunger 20 is an outwardly extending hood 22 defining a cavity equal to or greater than the volume defined by a chip 26 and overlying a semi-cylindrical opening 23*a* oriented in alignment with the hood 22 and the plunger 20 positioned adjacent the floor 23 of the cylindrical body 11. A thumb loop 24 extends from an upper surface of the hood 22 and is in general alignment with the middle finger loop 18 to provide a convenient reaction force of the thumb against the middle finger 18 in the dispensing of chips from the apparatus 10. A rib 25 is positioned within an interior surface of the cylindrical body 11, as illustrated in FIG. 3 for example, and coextensive with the cylindrical body and extending above the opening 23 to the semi-cylindrical recess 16. The rib 25, as illustrated in FIGS. 5 and 6, aligns unique chips utilized by the instant invention by projecting within recesses formed within chips 27 and 28, for example. This unique alignment orients the chips in a convenient manner when utilizing uniquely shaped chips, such as the heart shaped chip 28. The cylindrical chips 26 are also utilized and are of a diameter dimensioned to be received between the rib 25 and the opposed cylindrical surface of the interior wall surface of the cylindrical body 11.

As to the manner of usage and operation of the instant invention, the same should be apparent from the above disclosure and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bingo chip dispenser for selectively depositing bingo chips onto a playing surface, comprising, an elongate cylindrical body including a through-extending opening at an upper end and including a floor at an opposed end, the upper end includes a lid member selectively closing the upper end overlying the opening, and a first finger engagement member directed orthogonally outwardly of an exterior surface of the cylindrical body, and a second finger engagement member aligned with the first finger engagement member and formed contiguously thereto, and including a plunger positioned within the first finger engagement member directed diametrically interiorly of the cylindrical body, and an opening positioned adjacent the floor diametrically opposed to the plunger and receiving a bingo chip directed through the opening when the plunger is in a contracted orientation relative to the cylindrical body, and wherein a pivot hinge is integrally secured to an upper edge of the cylindrical body adjacent the opening and includes a pivot pin extending orthogonally upwardly thereof to pivotally mount the lid thereto, and the lid further including a projection diametrically opposed to the pivot pin and integrally secured to the lid and receivable within a semi-cylindrical recess formed within an upper edge of the cylindrical body diametrically opposed to the pivot hinge.

2. A bingo chip dispenser as set forth in claim 1 further including a third finger engagement member diametrically opposed to and aligned with the first finger engagement member.

3. A bingo chip dispenser as set forth in claim 2 wherein an elongate hood of a length equal to or greater than a bingo chip positioned within the cylindrical body extends orthogonally outwardly of the cylindrical body defining a cavity of a volume substantially equal to or greater than that of a bingo chip, and the third finger engagement member integrally secured to an upper surface at an outermost edge of the hood.

4. A bingo chip dispenser as set forth in claim 3 further including a spring captured between the cylindrical body and the plunger to normally bias the plunger in an outwardly extended position relative to the cylindrical body.

5. A bingo chip dispenser as set forth in claim 4 wherein the first, second, and third finger engagement members are each defined as loops.

6. A bingo chip dispenser as set forth in claim 5 wherein the first finger engagement member extends beyond the second finger engagement member and below the floor of the elongate cylindrical body to accommodate the plunger and a middle finger of a user of the bingo chip dispenser.

7. A bingo chip dispenser as set forth in claim 6 further including an integral rib secured to an interior surface of the cylindrical body coextensive with the interior surface parallel to an axis of the cylindrical body and orthogonally oriented relative to the plunger and receivable within a recess defined within the bingo chip stacked within the cylindrical body.

* * * * *